US009744398B1

(12) United States Patent
Stoddard et al.

(10) Patent No.: US 9,744,398 B1
(45) Date of Patent: Aug. 29, 2017

(54) HAND-HELD WEIGHTS WITH OPTIONAL DETERRENT DEVICES

(71) Applicants: Vickie L. Stoddard, Lynn, MA (US); Steven W. Stoddard, Lynn, MA (US)

(72) Inventors: Vickie L. Stoddard, Lynn, MA (US); Steven W. Stoddard, Lynn, MA (US)

( * ) Notice: Subject to any disclaimer, the term of this patent is extended or adjusted under 35 U.S.C. 154(b) by 332 days.

(21) Appl. No.: 14/081,336

(22) Filed: Nov. 15, 2013

Related U.S. Application Data

(60) Provisional application No. 61/863,635, filed on Aug. 8, 2013.

(51) Int. Cl.

| | |
|---|---|
| ***A63B 15/02*** | (2006.01) |
| ***A63B 71/00*** | (2006.01) |
| ***A63B 21/072*** | (2006.01) |
| ***A63B 21/075*** | (2006.01) |
| ***H04R 3/00*** | (2006.01) |
| *A63B 21/00* | (2006.01) |

(52) U.S. Cl.
CPC ..... *A63B 21/072* (2013.01); *H04R 3/00* (2013.01); *A63B 21/0004* (2013.01)

(58) Field of Classification Search
USPC ..... 482/1, 106–109
See application file for complete search history.

(56) References Cited

U.S. PATENT DOCUMENTS 2,908,901 A * 10/1959 Lewis ..... F21L 4/005 340/388.1
4,132,409 A * 1/1979 Taylor ..... F41B 15/02 463/47.6
4,533,140 A 8/1985 Champion
4,627,618 A 12/1986 Schwartz
4,689,776 A 8/1987 Thorndyke et al.
5,001,462 A 3/1991 Seemann et al.
5,135,454 A * 8/1992 Yeh ..... 482/108
5,192,074 A * 3/1993 Ashihara ..... F41B 15/02 463/47.4
5,286,244 A * 2/1994 Wright et al. ..... 482/108
5,325,997 A 7/1994 Washington et al.
5,428,514 A 6/1995 Fink, Jr.
5,556,003 A * 9/1996 Johnson et al. ..... 222/39
5,606,305 A 2/1997 Jan
5,827,142 A * 10/1998 Rappaport ..... A63B 59/50 473/567
5,865,348 A 2/1999 Harding
(Continued)

OTHER PUBLICATIONS

Mis Defense Products. Ultrasonic Dog Stop Devices. http://www.misdefenseproducts.com/Ultrasonic-Dog-Stop-Devices-p-1-c- 376.html (Oct. 10, 2009).

*Primary Examiner* — Sundhara Ganesan
*Assistant Examiner* — Shila Jalalzadeh Abyan
(74) *Attorney, Agent, or Firm* — Robert C. Montgomery; Montgomery Patent & Design, LP.

(57) ABSTRACT

A hand-held exercise weight system has integral self protective features within each weight system. Each weight system has an activation button located near the user's thumb. One (1) weight system is equipped with a loud audible alarm to signal for help in times of duress. The other weight system is equipped with an ultrasonic dog repellent system, which deters any possible attacking canines. Each weight system is provided with a user replaceable battery, and is self-contained and waterproof. Each weight system has a weighted body that is detachable from the system.

1 Claim, 4 Drawing Sheets

(56) References Cited

U.S. PATENT DOCUMENTS

| | | | | |
|---|---|---|---|---|
| 5,910,070 | A * | 6/1999 | Henry et al. | 482/4 |
| 6,059,700 | A * | 5/2000 | Ellenburg | 482/107 |
| D522,075 | S | 5/2006 | Cheng | |
| 7,458,921 | B2 | 12/2008 | Hallar | |
| 2003/0232705 | A1* | 12/2003 | Harms et al. | 482/108 |
| 2009/0038664 | A1* | 2/2009 | Juslin | A45B 3/00 135/66 |
| 2009/0221388 | A1* | 9/2009 | Giannetti | A63B 69/0002 473/457 |

* cited by examiner

HAND-HELD WEIGHTS WITH OPTIONAL DETERRENT DEVICES

RELATED APPLICATIONS

The present invention was first described in and claims the benefit of U.S. Provisional Application No. 61/863,635, filed Aug. 8, 2013, the entire disclosures of which are incorporated herein by reference.

FIELD OF THE INVENTION

The present invention relates generally to a pair of hand-held weights to be used while exercising, wherein each weight body is configured to receive a deterrent device.

BACKGROUND OF THE INVENTION

Modern concerns over health and physical fitness have produced an abundance of people who religiously participate in a variety of exercise regimens in order to stay in shape. One (1) of the most popular exercise activities is running or jogging. The muscular and cardiovascular workout associated with this activity makes it an effective means by which to stay fit. To further enhance their workout, many people carry hand-held weights in order to help build upper body strength as well as increase endurance. Unfortunately, many runners and joggers are the victims of physical assault by either humans or animals, such as canines. While devices such as pepper spray, shock systems, ultrasonic canine repelling systems, and the like, can be carried by the runner or jogger, such devices take time to access and activate. Accordingly, there exists a need for a means by which runners and joggers can be provided both an increased physical workout as well as physical protection. The development of the present invention fulfills this need.

The invention is a handheld exercise weight system with integral self protective features, and preferably comes as a pair to be held in each hand. Each weight system is provided with an activation button to activate the system. One (1) weight is equipped with a loud audible alarm to signal for help in times of duress such as during an assault, mugging, or the like. The other weight is equipped with an ultrasonic dog repellent system, which repels any possible attacking canine. The user simply presses the respective button on either hand-held weight, and is rewarded with immediate assistance. Each weight is provided with a user replaceable battery, and is completely self-contained and waterproof.

Prior art in this field consists of hand-held weights that sound an alarm or emit a protective spray. These prior art hand-held weights include dumbbell shaped weights with the internal electronics, speakers, and dispensing units incorporated and integrated with the weights themselves. A user is, therefore, unable to separate the weight portion from the audio and dispensing portions, if it is desirous to do so. Other apparatuses exist that a user may carry while jogging or running to assist with fending off an attack, but these do not serve a dual purpose of acting as a deterrent and increase the physical workout.

It is an object of this invention to provide a device that serves as both a hand-held weight and a deterrent for assailants while a user is jogging or walking outdoors.

It is a further object of this invention to provide a sound emitting device attached to a hand-held weight to enable a user to avail the sound to deter assailants.

It is a further object of this invention to provide a means to emit sound that will deter either a human or a canine assailant.

It is a further object of this invention to afford a user the ability to detach or attach the sound emitting device from the hand-held weight, at a user's discretion, so as to enable a user to carry just the hand-held weight, just the sound emitting device, or both the hand-held weight and the sound emitting device together.

An added benefit is to provide a waterproof structure to protect the internal electronics of the sound emitting device.

An additional benefit is to provide a modified end to each hand-held weight to provide supplementary dexterity and comfort for a user carrying the invention.

SUMMARY OF THE INVENTION

The system comprises a pair of hand-held weights, each having sound emitting capabilities, wherein each hand-held weight is configured to be the handle for the system. Bottom ends of each handle are provided with modified spherical ends to conform to a maximum level of dexterity and comfort for a user. A top end of each handle is fitted into a socket of a sound emitting head. One (1) sound emitting head preferably emits sound waves at a frequency that is different than that of the other sound emitting head. A first sound emitting head preferably emits sound within the audio frequency range, which is heard by an average human. A second sound emitting head preferably emits sound within the ultrasound frequency range, which is heard by an average canine.

Each sound emitting head is a casing with a hollow construction. The casing houses the electronic components necessary to operate the sound emitters. An end of each casing is provided with a removable cap to grant access to an interior of the casing, wherein a battery compartment is located. Electrical circuitry is routed from an interior of each casing to an activation button disposed on a side surface of the casing. When activated, electrical power is supplied to at least one (1) speaker from at least one (1) battery, both of which are located within the casing, to emit a sound. The sound is directed from each speaker to an exterior of the system via a plurality of sound channels disposed through a surface of the casing. The electronics and each speaker of the first sound emitting head are configured to emit sound within the audio frequency range typically heard by a human. The electronics and each speaker of the second sound emitting head are configured to emit sound within the ultrasound frequency range typically heard by a canine.

The system is envisioned to be employed while jogging or walking outdoors. The weighed nature of each hand-held weight provides added benefit to a persons exercise routine. The quick access to the sound emission means of each hand-held weight provides added security for a user. If advanced upon in a hostile manner, a user simply activates the first sound emitter head to sound an alarm for others to hear. Alternatively, a user activates the second sound emitter head to deter a canine attack. A user may also carry a first sound emitter head on one (1) weight and a second sound emitter head on another weight so as to have the capability to emit both sounds simultaneously. Moreover, a user may merely carry a weighted handle without a sound emitting head attached. Similarly, a user may merely carry a sound emitting head without a weighted handle attached.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
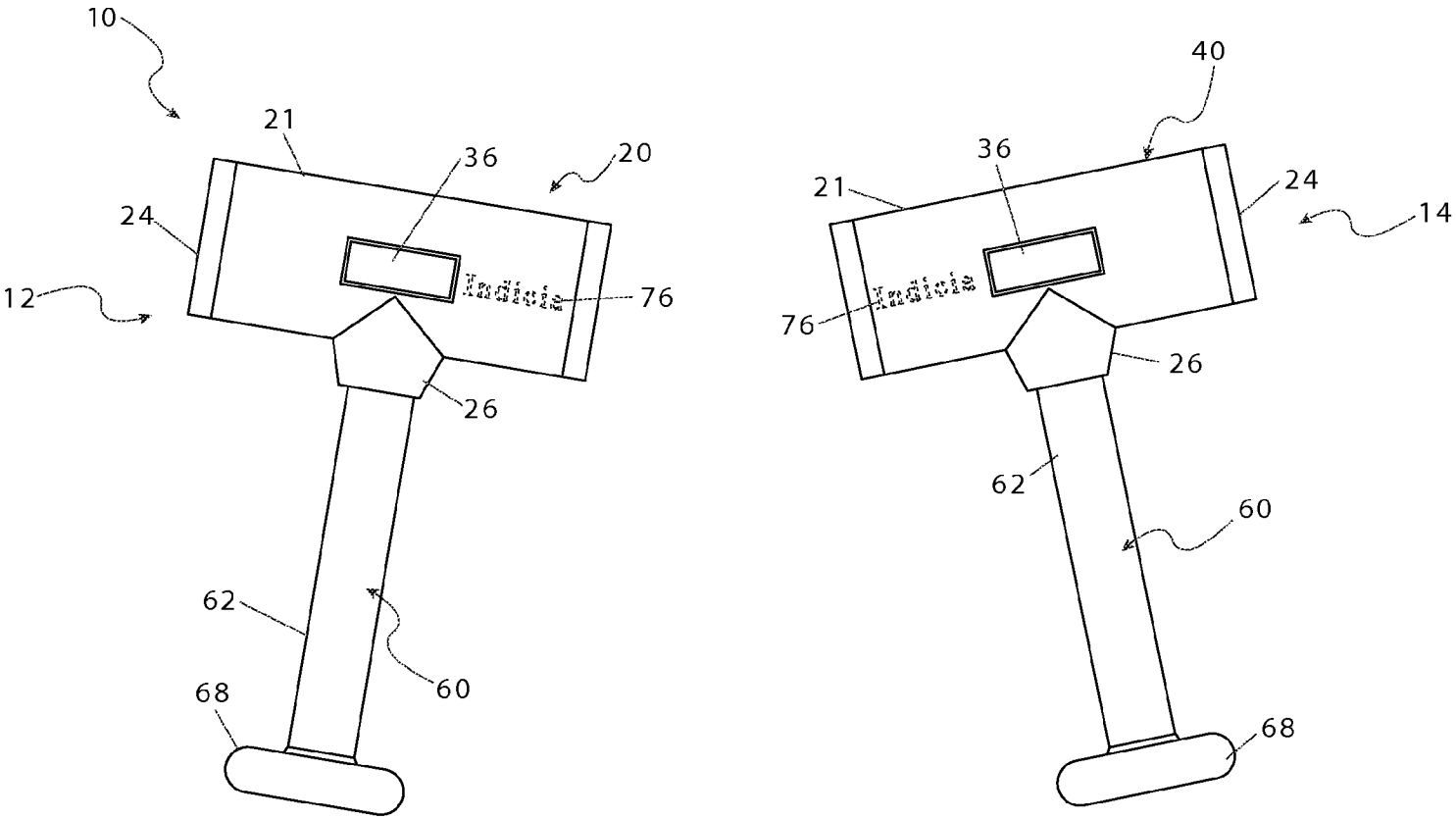
FIG. 1 is a plan view of a deterrent system 10 in accordance with the preferred embodiment of the present invention.

10 system
12 alarm weight
14 ultrasonic weight
20 alarm head assembly
21 head
22 cavity
23 internal thread
24 end cap
25 external thread
26 saddle
27 socket
28 socket slot
31 battery
32 battery holder
33 alarm circuit
34 speaker
35 sound channel
36 activation button
40 ultrasonic head assembly
42 ultrasonic wave generator
44 amplifier
46 ultrasonic speaker
60 handle assembly
62 body A
64 body B
66 shaft reduction
68 end
72 insert
76 indicia

DETAILED DESCRIPTION OF THE PREFERRED EMBODIMENT

In accordance with the invention, the best mode is presented in terms of a preferred embodiment, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

The present invention describes a hand-held exercise weight and deterrent system (herein referred to as the "system") 10, which provides a means to increase the benefits of a physical exercise regimen conducted with the use of additional resistance devices while having a system available to thwart an attack from a human or an animal assailant.

Figure 2:
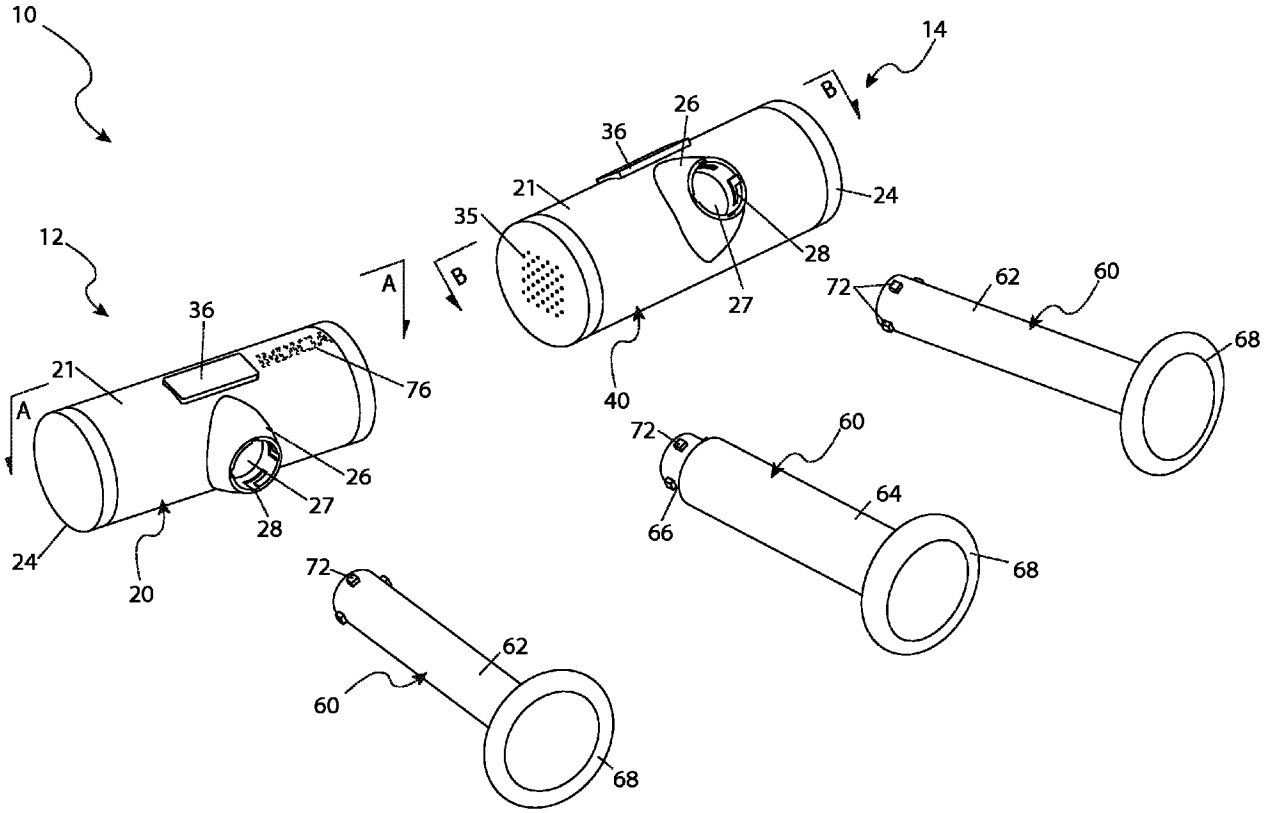
FIG. 2 is an isometric view of the deterrent system 10 depicted with the handle assemblies 60 detached from the alarm head assembly 20 and from the ultrasonic head assembly 40 in accordance with the preferred embodiment of the present invention.

Referring now to FIG. 1 and FIG. 2, plan and isometric views, respectively, of the system 10, according to the preferred embodiment of the present invention, is disclosed. The system 10 is comprised of a pair of hand-held weight bodies 62, 64, supplied in two (2) optional mass configurations, attached to sound producing modules which, because of the difference in the frequency of sound produced by each, can be referred to as an alarm weight 12 and an ultrasonic weight 14. The weight bodies 62, 64 are configured in the handle assembly 60 generally as metal cylinders of different diameters having a modified spherical end 68 to improve the grip of the handle assembly 60. The handle assembly 60 is retained in the socket 27 of each of the alarm head assembly 20 and the ultrasonic head assembly 40 by means of a plurality of raised, rectangular inserts 72 formed with the handle assembly 60 fitted into a corresponding number of socket slots 28 and rotated such that the inserts 72 travel along a ramp feature of the socket slots 28 and result in an interference fit between the end of the handle assembly 60 and the closed end of the socket 27. The weight body A 62 is the lesser of the two (2) optional masses and is formed with a uniform diameter along the length of the shaft and is preferably a weight of approximately one pound (1 lb.). The weight body B 64 has a larger mass by virtue of being formed with a larger diameter from the end 68 to the shaft reduction 66 whereupon the diameter is reduced to be accommodated in the socket 27 of the alarm head assembly 20 or the ultrasonic head assembly 40. The preferred size of weight body B 64 is approximately two pounds (2 lbs.).

The alarm head assembly 20 is comprised preferably of a thermoplastic material and constructed from a plurality of injection molded parts to form a cylindrical head 21, closed at one (1) end, to form a hollow cavity 22 for the disposition of those electrical and electronic parts which make up the alarm circuitry. The other end of the head 21 is further processed to incorporate internal threads 23, or other such grooves formed with a ramp feature, to accommodate the external threads 25, or other such projection features, of an end cap 24 which can be mated together and secured to the head 21 with a rotational motion. Disposed on the exterior of the head 21 and positioned at a mid-point along the length of the head 21 is the socket 27, formed to receive the handle assembly 60, and provided with a saddle 26 feature to accommodate the curvature of the head 21 to facilitate the permanent fastening thereto with an adhesive or other bonding material. The configuration of the alarm head assembly 20 is such as to maintain a waterproof structure, and prevents infiltration of water from an exterior of the system 10.

The preferred method of use of the system 10 maintains that the alarm weight 12 be grasped in the left hand of the user. Disposed at a mid-point along length of the head 21 of the alarm head assembly 20 in proximity of the thumb of the user's left hand is an activation button 36 which when depressed will complete the electrical circuitry within the alarm head assembly 20 and cause a loud audible sound to be emitted from at least one (1) speaker 34. This sound will attract the attention of other people in the vicinity of the user and discourage an assault by a human attacker. The activation button 36 may be depressed by the user's thumb or a part of the other weight.

The ultrasonic head assembly 40 is similar in appearance and construction to the alarm head assembly 20 with many of the same features such as end cap 24, socket 27, and activation button 36. The difference between the head assemblies 20, 40 is that the ultrasonic head assembly 40 contains the circuitry to emit a high frequency signal, in the range of twenty kilohertz (20 kHz) to twenty five kilohertz (25 kHz), when the activation button 36 is depressed in order to fend off a canine attack. The ultrasonic weight 14 would be grasped in a user's right hand. The configuration of the ultrasonic head assembly 40 is such as to maintain a waterproof structure, and prevents infiltration of water from an exterior of the system 10.

Either or both of the alarm head assembly 20 and the ultrasonic head assembly 40 may include indicia 76 which may provide script or logos based upon a user's preference and may include images such as, but not limited to, sports names/logos, personal names, symbols, pictures, directions for use, and the like to further customize and personalize the system further comprising a variety of colors and patterns.

Figure 3:
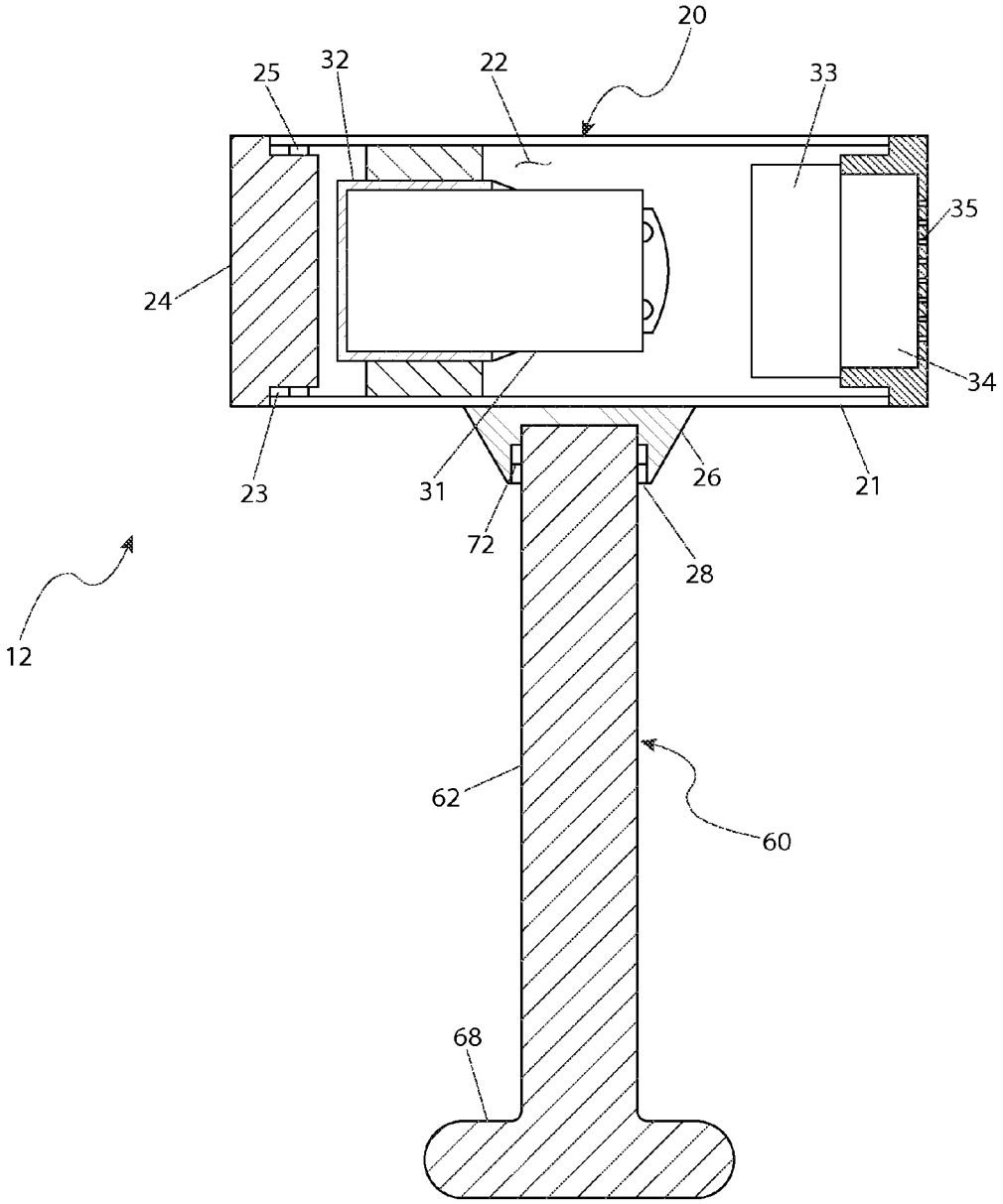
FIG. 3 is a section view of the alarm weight 12 along a line A-A as shown on FIG. 2 of the deterrent system 10 in accordance with the preferred embodiment of the present invention; and, FIG. 4 is a section view of the ultrasonic weight 14 along a line B-B as shown on FIG. 2 of the deterrent system 10 in accordance with the preferred embodiment of the present invention.

Referring now to FIG. 3, a section view of the alarm weight 12 along line A-A as seen in FIG. 2 of the system 10, according to the preferred embodiment of the present invention, is disclosed. The alarm head assembly 20 contains at least one (1) removable battery 31 contained in a battery holder 32. Each battery 31 is connected through the activation button 36 to the alarm circuit 33 which will transmit an electrical signal to a speaker 34 when activated. A plurality of sound channels 35 is disposed in the otherwise closed end of the head 21 through which the sound will travel. The closed end of the head 21 could alternately be provided with an end cap 24 with similar closing features as the other end without limiting the scope of the system 10. However, since the closed end of the head 21 contains no serviceable items, such as the battery 31, it would not be particularly beneficial.

Figure 4:
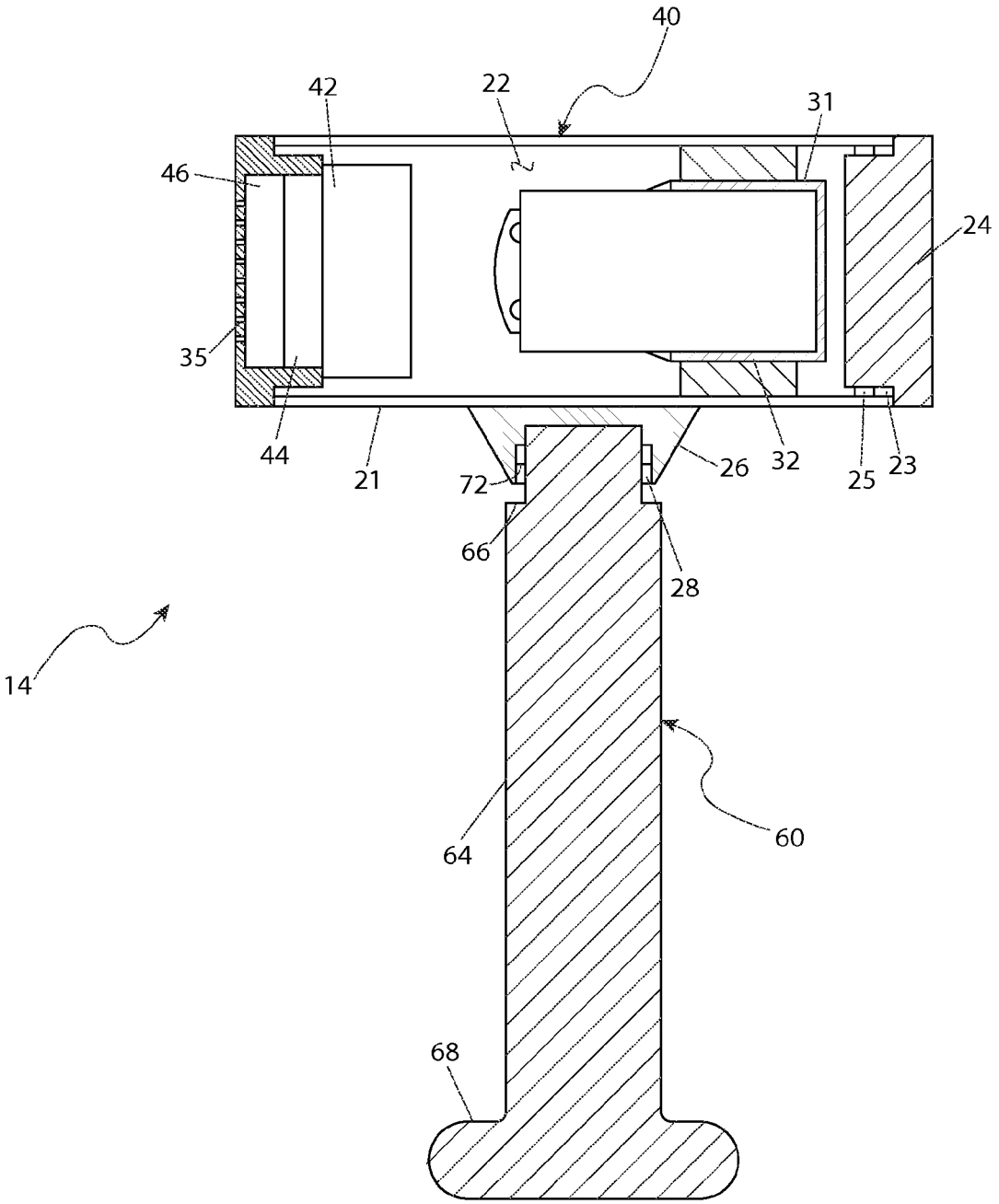

Referring now to FIG. 4, a section view of the ultrasonic weight 14 along line B-B as seen in FIG. 2 of the system 10, according to the preferred embodiment of the present invention, is disclosed. The ultrasonic head assembly 40 also contains a removable battery 31 contained in a battery holder 32. A battery 31 is connected through the activation button 36 to the ultrasonic wave generator 42 which will transmit an electrical signal to at least one (1) ultrasonic speaker 46 through at least one (1) amplifier 44 when activated. A plurality of sound channels 35 is disposed in the otherwise closed end of the head 21 through which the sound will travel.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the enabled user in a simple and straightforward manner with little or no training. After initial purchase or acquisition of the system 10, it would be configured as indicated in FIG. 1.

The method of utilizing the system 10 may be achieved by performing the following steps: acquiring a model of the system 10 having a desired style to suit a user's taste; installing a battery 31 of the proper size and voltage into the battery holder 32 of each of the alarm head assembly 20 and the ultrasonic head assembly 40; installing the handle assemblies 60 having the selected optional weight (weight body A 62, or weight body B 64); grasping the alarm weight 12 in the left hand with the activation button 36 oriented toward the left thumb; grasping the ultrasonic weight 14 in the right hand with the activation button 36 oriented toward the right thumb; running or jogging along a preselected course; depressing the activation button 36 on the alarm weight 12 in the left hand if a human assailant is encountered; depressing the activation button 36 on the ultrasonic weight 14 in the right hand if a canine assailant is encountered; and returning to safety.

In the event that an assailant of any type is encountered it may be difficult to remember which activation button 36 will emit the desired sound. This situation can be quickly and safely address by depressing both activation buttons 36. The system 10 can also be operated similarly with either body 62, 64 in either right or left hand of a user.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A hand-held exercise system, comprising:

at least one hand-held weight body, comprising:

an elongated shaft, having a top end and a bottom end;

a plurality of protrusions disposed about a surface of said top end;

a modified member disposed at said bottom end;

wherein said elongated shaft is metal having a cylindrical shape; and wherein said modified member is an annulus;

at least one sound emitter device, comprising:

a casing having a hollow construction;

a compartment formed within said casing and configured to receive and retain at least one battery;

a removable cap configured to cover and protect said compartment;

at least one speaker located within said casing;

electrical circuitry within said casing and configured to transmit electrical power from at least one battery placed within said compartment to said at least one speaker;

a control switch disposed on a side surface of said casing and placed into electrical communication with said electrical circuitry to enable selective connectivity or interruption of said transfer of electrical power from said at least one battery to said at least one speaker;

a socket assembly, comprising;

a saddle protruding from a side surface of said casing;

a receiving coupling formed into said saddle; and a plurality of slots formed into said coupling;

a first fastening means to removably secure said cap to said casing;

a secondary cap to cover a side of said casing opposing a side where said compartment is located;

a second fastening means to removably secure said secondary cap to said casing;

wherein said sound emitting device receives said hand-held weight by each protrusion inserting into each slot;

wherein said sound emitting device is removably coupled to said hand-held weight body by rotating said hand-held weight body after being received by said sound emitter device so that each protrusion traverses an individual slot of the plurality of slots and forms an interference fit thereto;

wherein said casing is configured to prevent water infiltration into an interior of said casing;

wherein said casing is plastic and has a cylindrical shape;

wherein each slot of said socket assembly is configured as a ramp and slide arrangement;

an amplifier placed in electrical communication with said at least one speaker; and wherein each speaker is configured to emit sound within an ultrasound frequency range heard by a canine through a plurality of sound channels.

* * * * *